United States Patent [19]

Leib

[11] Patent Number: 4,555,139

[45] **Date of Patent: * Nov. 26, 1985**

[54] PATIENT'S DEFINED-MOTION CHAIR

[76] Inventor: Roger K. Leib, 1064 Crescent Heights Blvd., Los Angeles, Calif. 90053

[ * ] Notice: The portion of the term of this patent subsequent to Jul. 16, 2002 has been disclaimed.

[21] Appl. No.: 480,357

[22] Filed: Mar. 30, 1983

Related U.S. Application Data

[63] Continuation-in-part of Ser. No. 368,521, Apr. 15, 1982, , which is a continuation-in-part of Ser. No. 248,852, Mar. 30, 1981, , which is a continuation-in-part of Ser. No. 110,340, Jan. 7, 1980, abandoned.

[51] Int. Cl.[4] ..... A47C 3/02

[52] U.S. Cl. ..... 297/460; 297/258; 297/285; 297/287; 297/445

[58] Field of Search ..... 297/445, 452, 460, 458, 297/285, 459, 294, 258, 287, 311

[56] References Cited

U.S. PATENT DOCUMENTS

| | | | |
|---|---|---|---|
| Re. 27,176 | 9/1971 | Froelich | 297/284 |
| D. 252,901 | 9/1979 | Peterson | D6/72 |
| D. 262,502 | 1/1982 | Wilson | D6/56 |
| D. 267,757 | 2/1983 | Leib . | |
| 458,140 | 8/1891 | Bangs | 297/460 |
| 693,323 | 2/1902 | Gritton . | |
| 1,791,453 | 2/1931 | Mies | 155/50 |
| 1,928,939 | 10/1933 | Larsen . | |
| 1,950,226 | 3/1934 | Cable | 155/50 |
| 1,979,073 | 10/1934 | Larsen | 155/50 |
| 2,064,137 | 12/1936 | Zerbee | 155/50 |
| 2,069,456 | 2/1937 | McGowen | 297/287 |
| 2,071,084 | 2/1937 | Nolon | 297/445 |
| 2,121,130 | 6/1938 | McGowen | 155/178 |
| 2,135,657 | 11/1938 | Church | 155/119 |
| 2,186,705 | 1/1940 | Lorenz | 155/50 |
| 2,530,924 | 11/1950 | Turner | 297/458 X |
| 2,625,205 | 1/1953 | Holmes | 297/295 |
| 2,699,200 | 1/1955 | Lingle | 155/55 |
| 2,970,638 | 2/1961 | Halter | 297/460 X |
| 3,092,417 | 6/1963 | Drabert | 297/291 |
| 3,131,970 | 5/1964 | McGregor | 297/445 |
| 3,147,997 | 9/1964 | Mason | 297/452 |
| 3,165,356 | 1/1965 | Geier et al. | 297/460 X |
| 3,361,471 | 1/1968 | Radford | 297/460 X |
| 3,606,464 | 9/1971 | Arbuthnot | 297/460 |
| 3,716,270 | 2/1973 | Frazier | 297/460 |
| 3,762,769 | 10/1973 | Poschl | 297/460 |
| 3,815,955 | 6/1974 | Gibilterra | 297/295 |
| 3,876,250 | 4/1975 | Eberle | 297/446 |
| 4,049,315 | 9/1977 | Jacobson | 297/447 |

FOREIGN PATENT DOCUMENTS

| | | | |
|---|---|---|---|
| 764919 | 3/1934 | France . | |
| 529845 | 1/1955 | Italy | 297/445 |
| 74283 | 5/1932 | Sweden | 297/295 |

OTHER PUBLICATIONS

"Patient Rocking Chair"-Hospitals Magazine, Jun. 1, 1980.

"Chair"-Health Care Product News, Aug. 1980.

"Special Seating"-Contract Magazine, Nov. 1980.

"List Prices"-Add Interior Systems, Inc., Jun. 15, 1981.

"The Warren Chair (for my father)"-Add Interior Systems, Inc., Aug. 1981.

*Primary Examiner*—James T. McCall

*Attorney, Agent, or Firm*—Jeffrey G. Sheldon

[57] ABSTRACT

A chair, especially suited for use by sitters lacking in normal strength, provides a lilting motion without shifting the base of the chair, and provides support and assistance to the sitter in exiting the chair. The seat and back of the chair are supported by continuously flexible members, and the back is orthopaedically designed for maintaining spinal support, even as a user of the chair moves with the motion of the chair.

21 Claims, 7 Drawing Figures

PATIENT'S DEFINED-MOTION CHAIR

This application is a continuation-in-part of copending application Ser. No. 368,521 filed Apr. 15, 1982, which is a continuation-in-part of application Ser. No. 248,852 filed Mar. 30, 1981, which is a continuation-in-part of application Ser. No. 110,340 filed Jan. 7, 1980, now abandoned. Each of these applications is incorporated herein by this reference.

BACKGROUND

This invention relates to a chair which because of its characteristics and construction, as will be described, facilitates use by weakened, partially disabled, or infirm users suffering a variety of ailments in a manner constituting a distinct improvement over patient-type chairs of the prior art. Because of the comforts it provides, the chair of the invention also is appropriate for the seating needs of healthy users, and it is also a distinct improvement over chairs of the prior art for general seating use.

An important feature of this chair is its ability to provide a defined motion pattern in response to the body pressure of the user, such that the motion constitutes a controlled pattern and a relaxing sensation for the user.

There are many chair configurations which have found use in the hospital room, nursing home, extended care facility, sick room at home or as loungers for general use. No chair now available has the desirable motion characteristics of the chair described herein.

A major drawback of presently available chairs is the widespread problem of weakened users being unable to get out of the usual easy, or lounge, chairs by themselves because they haven't the strength to do so in the particular groups of muscles called into play by the configuration of the chair they were trying to get out of (typically the arm and upper body muscles). The problem is compounded by the relatively widespread incidence of back problems common among nurses and aides because of their having through their shift to help patients or wards out of chairs and into standing positions. One object of the invention is to provide a chair which enables the user to utilize his strongest muscles (usually leg muscles) for rising up out of the chair, by providing, in effect, a catapulting motion to the user.

Another problem with prior art chairs used in health care settings is the lack of seated comfort they provide. A major factor in this discomfort is the stationary aspect of the seating. Provision for some form of effortless motion prevents the concentration of pressure points at specific locations on the body which contact the chair and support weight.

This aspect of seating discomfort is caused by the inevitable concentration of body weight on specific portions of flesh. Under normal conditions of health and mobility, such pressure results in the desire to shift body weight and redistribute the pressure. However, in a weakened state and in a static chair, patients may be unable to do so. In the present invention, the natural motion of the chair provides relief.

Thus, an object of the present invention is to provide a chair in which slight rocking or lilting motion can be achieved, which provides an opportunity for exercise to the debilitated user; and which also allows the constant partial shifting and redistribution of body weight and helps the patient to dissipate institutionally and health-related anxieties by moving and rocking.

A problem with chairs of the prior art that accommodate a rocking motion by the user, is that the axis of rotation usually falls somewhere between the user's knees and pelvis, so that as the user rocks backward, there is a tendency for the knees to move upwardly, causing the feet to leave the floor and creating an excess of pressure on the underside of the thighs. In addition, there is a further tendency in the prior art chairs, as the user pushes downward on the fronts of armrests in order to lift himself upwardly, for the armrest fronts to rotate downwardly, opposite the direction in which the user is trying to push. Thus, another object of the present invention is to provide a chair with a rocking motion, the axis of which is located in front of the knees, and armrest fronts remain stable while the body rotates backward into the chair back; and one that has no tendency to rock forwardly when the user pushes down on the armrests to lift himself out of the chair.

Another problem of many prior art chairs is instability in use, since many health care chairs have a tendency to tip forwards, sideways, or backwards under the varied conditions in which users try to enter and exit them. An object of the present invention is to provide a chair which will be stable under all normal circumstances of use.

A further problem encountered in the health care field is a variety of functions or treatments not normally performed in a lounge chair which must be performed or endured by a patient occasionally or intermittently while seated in the same chair. One such function is eating, another is urinating, another is the draining of body fluids into drainage bags, and still another is sitting upright or remaining seated under conditions of semi-consciousness or disorientation. A further object of the present invention is to provide a chair which accepts a variety of optionally used fittings to accommodate this diverse range of needs.

Yet another problem with many prior art chairs used in health care settings is the manner in which impact is absorbed when a user drops into the seat. The most common means of absorbing impact shock is with heavy padding, which besides its potentially hygienic limitations, if effective, often permits the sitter to sink too low to be able to lift himself out of the chair easily, and creates both bulk and weight which limit an institutional staff's ability to move the chair and adequately perform necessary floor maintenance operations.

Such stuffing materials also often create fire hazards by the use of highly combustible materials which generate high smoke density and toxicity on combustion. A further object of the present invention is to provide a chair of minimum required bulk which permits minimal use of materials that would fuel a fire and the structure of which absorbs initial impact by the user.

Another common problem with many prior art chairs is that the back is not orthopedically designed to provide good spinal support. Even chairs with orthopedically designed backs have problems in that as the user of the chair moves, the back support stays rigidly in position and does not flex, with the result that optimum spinal support is not maintained. This relative movement between a chair back and a sitter's spine can result in discomfort, particularly for hospital patients.

Thus, there is a need for a chair which can be used both by weakened and healthy sitters, is easy to get out of, provides a rocking motion, is stable, can be used for functions and treatments provided in the health care field, is a minimal fire hazard, and provides firm spinal support even for an active sitter.

SUMMARY

The present invention is directed to a chair which meets these requirements. The present invention provides a chair which is primarily though not exclusively intended for use by the weakened, partially disabled, or infirm user such as are typically found in hospitals, nursing homes, extended care facilities, and sickrooms, and which is directed primarily at the geriatric, orthopedic, rehabilitating, psychiatric, and maternity patient. It is particularly suited to these applications in that it is easy to enter and exit, provides with no moving parts a soothing slight rocking motion that increases rearwardly in order to shift and redistribute body weight without lifting the feet off the floor while maintaining stable arm fronts against which to push in exiting, minimizes skeletal shock upon sitting impact without padding of any kind which might potentially fuel a fire, and remains stable in all normal use.

The chair as described above consists of a tubular or barstock steel base frame, vertical leg components which support tubular or bar stock steel side frames which in turn support a seat and back member constructed of flexible material. The seat and back member may be formed of any suitable upholstery material, and the chair may be constructed so that the seat and back member may be removed for replacement purposes.

A major advantage of the chair is the placement and support of armrests. They are axially supported at their front end by a relatively rigid member so all downward force exerted at their front ends is resisted by the vertical legs of the chair acting as axial struts, thus providing the user a stable stratum against which to push for exiting the chair. Furthermore, these armrests extend well past the seat front, enabling the user to first pull himself far forward enough so that he is then pushing downwardly over the center of gravity of his feet enabling his leg muscles to perform a substantially higher proportion of the work than his arm and upper body muscles would otherwise have had to perform.

Another advantage is that portions of the seat and back that actually support the user's weight are a structurally efficient tensile sling, allowing use of a minimal amount of material in one thin layer. As shown in one embodiment, this sling consists of an open polyester mesh which provides both full ventilation to the user and complete washability. The amount of material required is so minimal, in fact, that it dries quickly without trapping water and contributes so little potential fuel that it is not subject to present flammability laws governing upholstered furniture.

Another advantage of the chair is the seated comfort it provides. The front-cantilevered side frame deflect rearwardly, leaning the user back into the chair with a slight but soothing rocking motion which further shifts concentration of the user's body weight to different tissue areas as his center of gravity shifts correspondingly back and forth. Since the point of fixing of the flexing cantilevered side frames is at their front end, the corresponding axis of rotation of side frames is just above and in front of the knees, which therefore remains relatively stable so there is no lifting off the floor of the user's feet.

A further advantage of this unique structure is that the seated stroke patient can, with light downward pressure applied atop the head, be moved in an up and down direction, thus providing vestibular stimulation and an enhanced sense of direction and balance.

Furthermore, the optimally-placed lumbar support gives adequate support to the critical lumbar region, while the headrest can be adjusted up or down via hook and loop tape fasteners to correspond with the small of the neck within the range limited by its permanently sewn attachment straps. And as the user drops into the chair, the flexure of the side frames absorbs impact and prevents skeletal shock, for which heavy padding might otherwise be needed.

For optimum spinal support, the back of the chair is generally S-shaped in elevation, having a lower section convex relative to the seat and an upper section concave relative to the seat. The convex section has a radius of curvature at its apex of from about 4 to about 7 inches and the concave section has a radius of curvature at its apex of from about 30 to about 50 inches. The apex of the convex section is from about 5 to about 8 inches above the seat plane and the apex of the concave section is from about 16 to about 21 inches above the seat plane. The apex of the concave section is rearward of the apex of the convex section by about 2 to about 4 inches.

Preferably the chair is formed from a pair of spaced apart, converging seat-supporting members and a pair of spaced apart, converging, back-supporting members that are continuous with and extend upwardly from the rear of the seat-supporting members. These structurally unitary seat-supporting members and back-supporting members are continuously flexible. With this structure, the back supports are able to flex at the same points as does the spine of the sitter. Moreover, where the seat and back are formed from a resilient web extending between the seat and back-support members, the sitter's seat and back sink into the support sufficiently that the center of the spinal column is approximately in line with the curves of the contoured back-support members. This enables the chair back to duplicate the spine's movement with negligible relative movement between the chair back and the sitter's spine.

Yet another advantage of the chair is that the portions of the base that are on the floor are sized large enough so that the user's center of gravity always falls within those boundaries delineated by the base, thus precluding any instability in normal use.

A further advantage is that the skeletal nature permitted by the chair's structure permits the attachment of a multitude of accessories to accommodate the treatments or functions not normally performed in a lounge chair.

DETAILED DESCRIPTION

In an embodiment shown in FIGS. 1, 2, 3 and 3A, the construction comprising seat and back supporting structures of the chair of the present invention is effectively cantilevered from channels atop the upright front leg supporting members. This results in a flexibility of support which permits the user to "rock" in a fashion not possible in ordinary rocking chairs.

The composite of the cantilevered seat and back supporting structure attached upon resilient rubber pads to the channels atop the front upright supports results in a vertical deflection of the seat and back support assembly of 0.5 inches or more at a point measured 12 inches horizontally back from the seat front under a load of 100 lbs. placed 12 inches horizontally back from the seat front. A horizontal deflection of $\frac{5}{8}$ inch or more measured 12 inches vertically from the seat is associated with the vertical deflection, under a 50 lb. load directed horizontally at a point 12 inches vertically above the seat. The period of these deflections is 0.20 second or more, i.e., an undamped primary elastic period of vibration along the plane of the seat.

Figure 3:
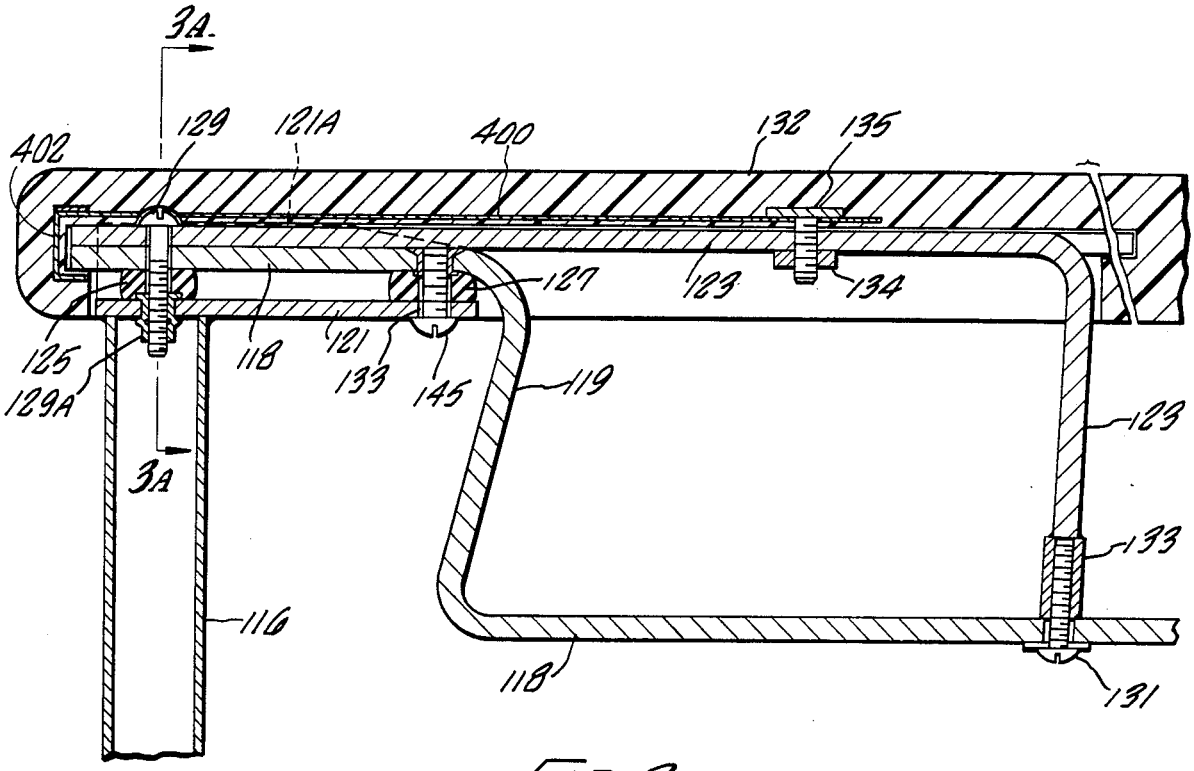
FIG. 3 is an enlarged sectional view of the arm assembly of the chair of FIG. 1, taken along line 3—3 of FIG. 1.
Figure 3A:
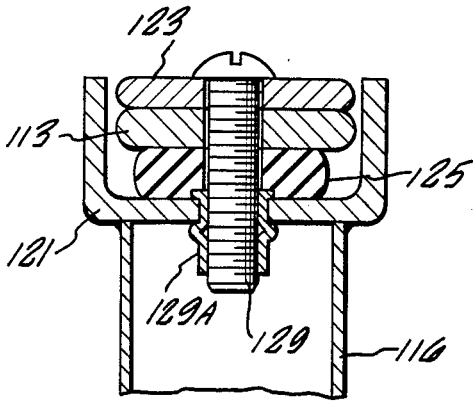
FIG. 3A is a sectional view of the arm of the chair of FIG. 3 taken along line 3A—3A of FIG. 3.

In the embodiment of FIGS. 1, 2, 3 and 3A, the chair includes a base formed, for example, of tubular steel. The base has two spaced and parallel side sections 112, a transverse section 114, and two spaced and generally parallel upright legs 116 at the forward end thereof. As shown in FIG. 3, the upper end of each of the legs 116 is welded to an elongated, upright U-channel which may be formed of $\frac{1}{8}$"-thick mild steel. The steel channel 121 provides mounting and lateral containment for two spaced and parallel side frame members 118 which constitute the seat supporting section of the chair, and two spaced and converging side members 120 which constitute the back supporting section of the chair. The steel side frame members 118, 120 are held spaced apart in position by three transverse bars 136, 138 and 140.

Figure 2:
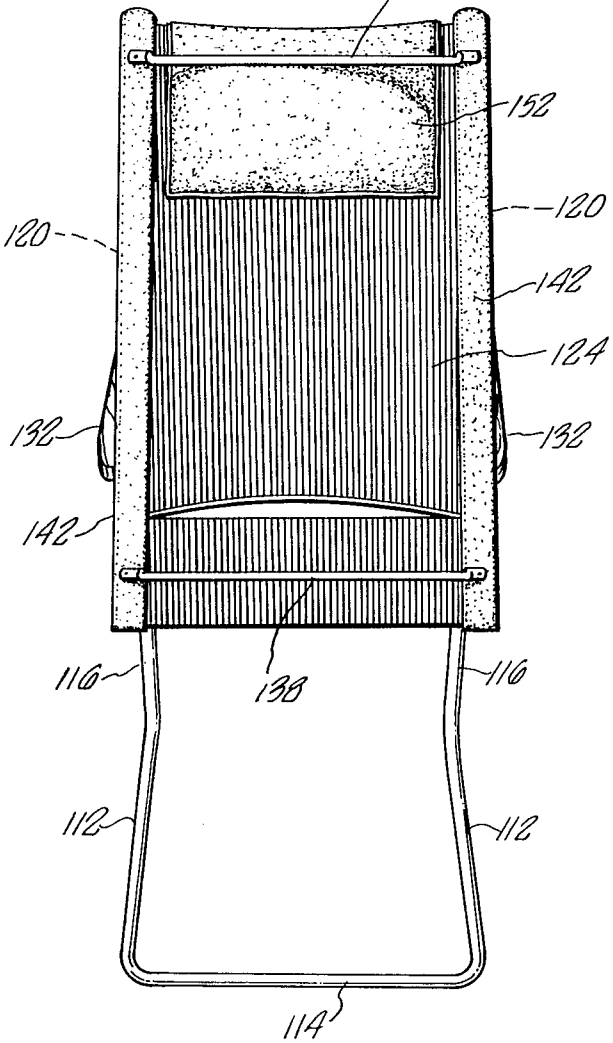
FIG. 2 is a rear perspective view of the chair of FIG. 1.
Figure 1:
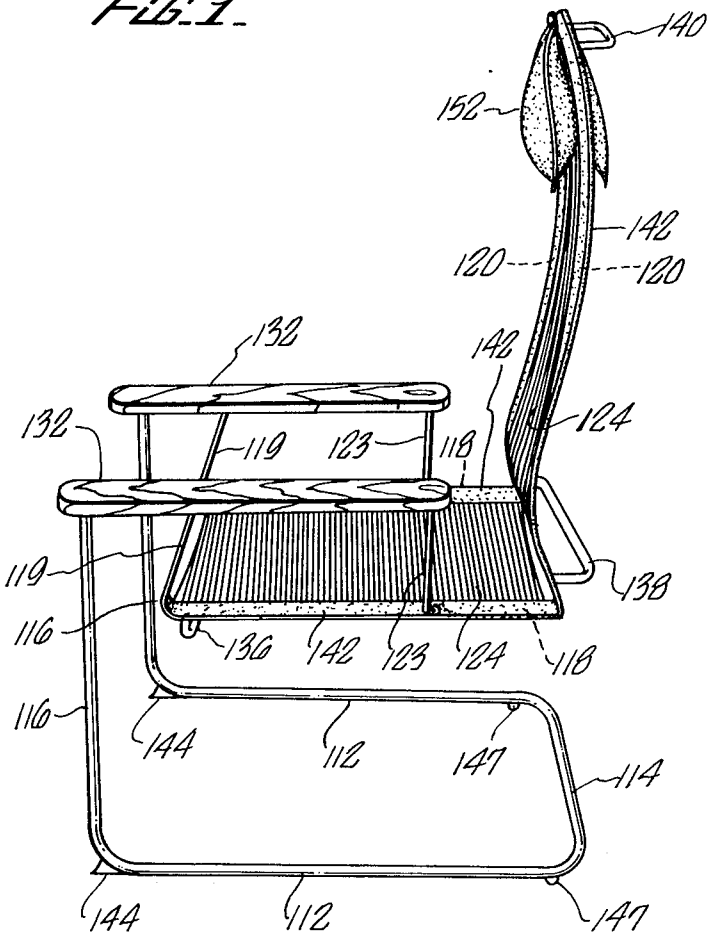
FIG. 1 is a side on perspective view of a chair according to the present invention.

The two seat-supporting side frame members 118 also each have a forward Z-shaped section 119 which, as shown in FIGS. 1 and 3 extends upwardly from the corresponding side frame member 118 and under a corresponding arm rest pad 132. The frame members 118 and 120, and section 119, and strip 123 on each side of the chair constitute a cantilevered leaf-spring assembly capable of being deflected with respect to leg 116 through a substantial range as set forth above without permanent distortion or set. These members may be formed of flat steel barstock, heat treated and tempered to have spring action mechanical properties. As shown in FIG. 3, the forward end of each section 119 extends between the channel welded to the upper end of leg 116 and an L-shaped steel strip 123. The purpose of the L-shaped steel strip 123 is to pull down the rear end of the arm rest pad 132 when the seat is deflected downwardly and to give added strength to the seat-supporting frame member 118 so that the combination of members will have additional loadbearing capacity. Soft neoprene ® rubber spacers or washers 125 and 127 are provided between the channel 121 and section 119 in order to enhance the apparent resiliency of side frame member 118 and to prevent the sharp upper rear corner of channel 121 from creating a point of concentrated stress on frame member 118 at their point of contact.

Section 119 is secured to channel 121 by a bolt 129 mounted in an insert 129A. The bolt 129 extends through the strip 123, the side frame 118, the spacer 125, and the channel 121, and is tightened until the spacer 125 is slightly compressed. The spacer 125 is between the side frame member 118 and the channel 121. The rear end of strip 123 is secured to member 118 by a bolt 131 which is received in a threaded sleeve 133 welded into the end of strip 123. Arm rest pad 132 is fixed in place (1) near its midsection by a nut 134 and threaded stud 135 extending through the strip 123, the head of the stud 135 being embedded in the armrest; and (2) at its front end by overlapping the section 118 and the strip 123; and (3) at its rear end by overlapping the section 123 only. A bolt 145 extending through spacer 127 and threaded into an insert 133 limits the motion of section 118 relative to channel 121 in order to preclude prying the head off bolt 129.

By disengaging retainer nut 134 from the protruding stud 135, pulling the stud out of the hole in member 123, and then pulling forward and then up on the armrest pad 132, the front of the armrest may be pulled over and disengaged from section 119 and strip 123, giving access to the head of bolt 129. Tightening or loosening the bolt 129 against the soft rubber spacer 125 adjusts the angle of inclination of the side frame member 118 (the inclination of the seat) to accommodate more exactly to various patient weights by increasing the height of the rear of the seat for heavier patients.

An advantage of using a channel 121 for the arm rather than a flat plate is that the lateral load carrying capacity of the arm frame is greatly increased and the overall height of the arm rest cover pad 132 is decreased, giving the chair a better aesthetic appearance.

The assembly described above provides a strong support for the seat of the chair and yet provides for the resilient rocking or lilting action by the occupant. Optionally, and preferably, the members 112 and 116 form an open front so that an ottoman may be slid and stored under the chair.

A pair of spring steel straps 400 are embedded in the arm rest pad 132 for added strength and resiliency and to prevent the armrest pad from being pulled off forwardly. A front end channel 402 is embedded in the armrest pad 132 so as to position itself placed over the front end of the side frame member 118 and the strip 123 to keep member 118 and the strip 123 engaged in the appropriate hollow of the arm rest pad 132.

A member constructed of appropriate flexible material 124 wraps around and is supported on the side frame members 118 and 120 to constitute the seat and back of the chair.

If desired a head cushion 152 may be adjustably attached to the back, for example, by appropriately sewn and located limiting straps and hook and loop fastener tape. A pair of floor glides 147 formed of non-marking rubber or other appropriate material, are attached to the rearward underside of the base to prevent the chair from backsliding when the patient is getting up out of the chair. For additional stability, a pair of members 144, formed of plastic or other appropriate material may be attached to the forward end of the base, as shown, to prevent forward tipping of the chair.

Figure 5B:
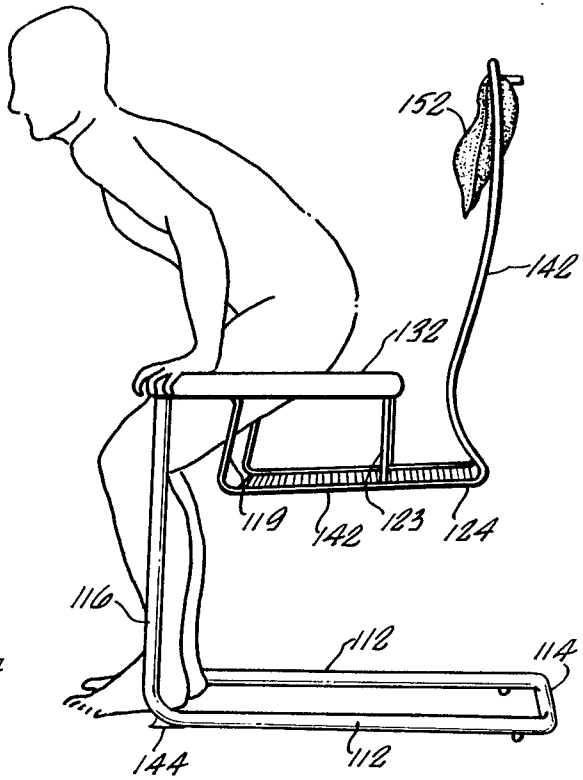
FIG. 5 is a side elevation showing how a user, having first pulled himself forward, can push vertically down over the center of his feet (FIG. 5A) thus calling his leg muscles into play in rising out of the chair into a standing position (FIG. 5B)
Figure 5A:
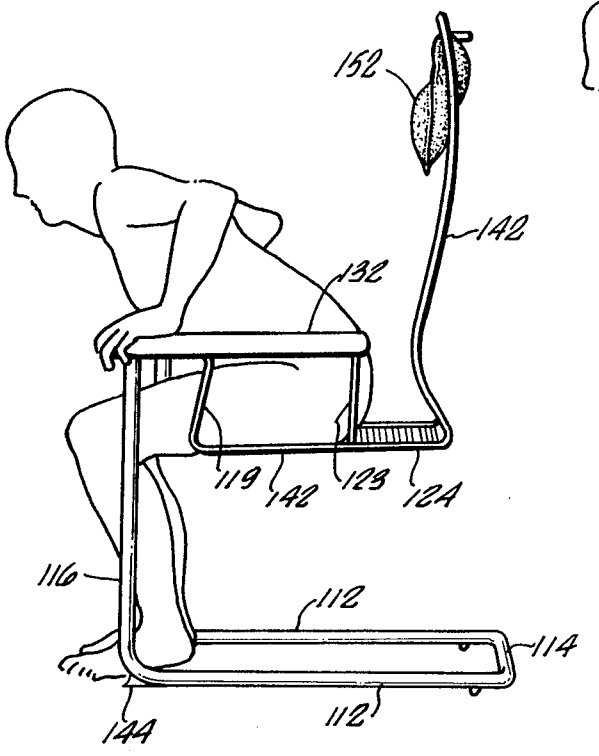
Figure 4:
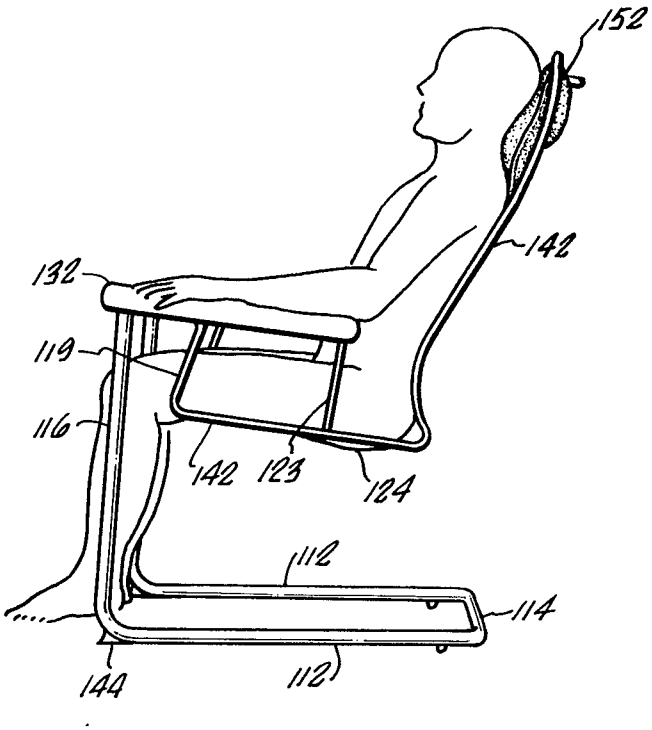
FIG. 4 is a side elevation of the chair of FIG. 1 under loading in normal use.

It should be noted that the forward edge of the seat is displaced rearwardly of the legs 116 by a substantial amount to assist the sitter in getting out of the chair because by pressing down on the forward ends of the arm rests 132 against the top of the rigid legs 116, he is pushing axially over the lower part of his legs and the center of gravity of his feet, bringing his lower body muscles into play in rising out of the chair, as shown in FIGS. 4 and 5.

Thus, in combination with the flexible chair structure, the arms of the sitter, when gripping the armrest fronts, form radial arms, with the sitter's hands at the fulcrum, about which the shoulders and upper body of the sitter move in an arc toward the standing portion. The ease of exit thus facilitated is achieved in part by the position of the armrest fronts in relation to the weight focus of the sitter, i.e., the position of the armrest fronts is set at least 15 inches forward of the seat/-back interface and substantially even with the upright members as shown in FIGS. 4 and 5. This is also aided by the catapult-like action of the flexible seat/back structure.

The side-supporting members 118 and the back-supporting members 120 are structurally continuous and are continuously flexible, i.e., they can bend at any point past their front fixing in response to forces exerted by the sitter. Further, due to the mounting system shown in detail in FIG. 3, the seat supporting members and the back supporting members are cantilevered to rock or deflect about a horizontal axis that is in the front portion of the arm supports, which is both above and in front of the seat.

Figure 6:
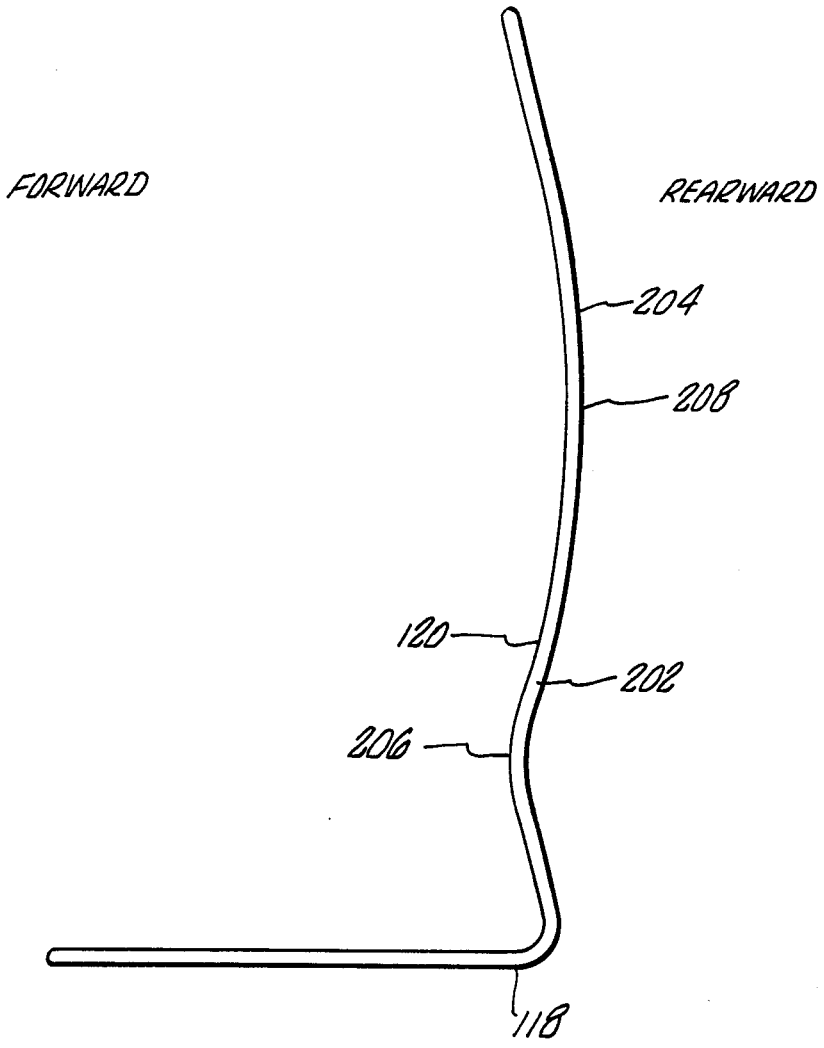
FIG. 6 is a sectional view of a preferred back-supporting member suitable for the chair of FIG. 1.

The back-support members 120 are advantageously orthopaedically designed for comfort and excellent spinal support. The shape of the back support member will now be described with reference to FIG. 6. This description makes reference to the directions "forward", "rearward", and "seat plane". The directions "forward" and "rearward" refer to the direction a person sitting on the chair faces and are indicated in FIG. 6. The "seat plane" refers to the plane of the seat. The seat plane can be parallel to the ground, or generally is slightly tilted rearwardly to the ground, and the angle between the seat plane and the ground varies when the chair is being used due to the lilting motion of the seat. All dimension presented herein, unless indicated otherwise, are when the chair is unoccupied.

With reference to FIG. 6, the back-supporting members are generally S-shaped, having a lower section 202 convex relative to the seat plane and an upper section 204 concave relative to the seat plane. The convex section 202 has a radius of curvature at its apex 206 of from about 4 to about 7 inches, and preferably about 5½ inches. The concave section has a radius of curvature at its apex 208 of from about 30 to about 50 inches, and preferably about 40 inches. The apex 206 of the convex section is from about 5 to about 8 inches, and preferably about 7 inches, above the seat plane. The apex 208 of the concave section 204 is from about 16 to about 21 inches, and preferably about 18 inches, about the seat plane. The apex 208 of the concave section 204 is rearward of the apex 206 of the convex section 202 by about 2 to about 4 inches measured parallel to the seat when the chair is unoccupied.

Preferably the chair is highback, with the top of the back of the chair being from about 28 to about 34 inches above the seat plane.

As shown in FIG. 6, the mid section of the seat back between the apices 206 and 208 extends rearwardly and upwardly at an angle of from about 74 to about 77 degrees, and preferably about 75½ degrees, relative to the seat plane. The section from the apex 208 of the convex section 204 to the top of the back of the chair extends forwardly and upwardly at an angle of from about 72 to about 77 degrees, and preferably about 74½ degrees, relative to the seat plane.

It will be appreciated that while particular embodiments of the invention have been shown and described, modifications may be made, including both a high-backed version and a low-backed version, and it is intended in the following claims to cover all the embodiments which come within the true spirit and scope of the invention.

What is claimed is:

1. A chair capable of a lilting motion comprising a pair of spaced apart, parallel seat-supporting members and a pair of spaced apart, converging back-supporting members continuous and extending upwardly from the rear of the seat-supporting members, the seat-supporting and back-supporting members defining in elevation a seat and a back for the chair, the seat-supporting members and the back-supporting members being cantilevered rearwardly to deflect about a horizontal axis above the seat, the back-supporting members being generally S-shaped in elevation and having a lower section convex relative to the seat plane and an upper section concave relative to the seat plane, the convex section having a radius of curvature at its apex of from about 4 to about 7 inches and the concave section having a radius of curvature at its apex of from about 30 to about 50 inches, the apex of the convex section being from about 5 to about 8 inches above the seat plane and the apex of the concave section being from about 16 to about 21 inches above the seat plane, the apex of the concave section being rearward of the apex of the convex section.

2. The chair of claim 1 in which the apex of the concave section is rearward of the apex of the convex section by from about 2 to about 4 inches measured parallel to the seat plane when the chair is unoccupied.

3. The chair of claim 1 in which the horizontal axis about which the seat-supporting members and the back-supporting members are cantilevered to deflect is in front of the seat.

4. The chair of claim 1 in which the convex section has a radius of curvature of about 5½ inches, the concave section has a radius of curvature of about 40 inches, the apex of the convex section is about 7 inches above the seat plane and the apex of the concave section is about 18 inches above the seat plane.

5. The chair of claim 4 in which the top of the back is about 28 to about 34 inches above the seat plane.

6. The chair of claim 1 in which the seat-suporting members and the back-supporting members are continuously flexible.

7. The chair of claim 1 in which the seat and back are each formed of a flexible member supported by the seat-supporting and the back-supporting member.

8. The chair of claim 1 including arm rests generally parallel to the plane of the seat and extending forwardly beyond the front of the seat, wherein the horizontal axis about which the seat-supporting members and the back-supporting members are cantilevered to deflect is near the front of the arm rests.

9. A chair capable of a lilting motion comprising a pair of spaced apart, parallel seat-supporting members and a pair of spaced apart, converging back-supporting members continuous and extending upwardly from the rear of the seat-supporting members, the seat-supporting and back-supporting members defining in elevation a seat and a back for the chair, the seat-supporting members and the back-supporting members being continuously flexible and being cantilevered to deflect about a horizontal axis above the seat, the back-supporting members being generally S-shaped in elevation and comprising three sections, a first section curving upwardly and forwardly relative to the seat plane, a second section curving from the first section rearwardly and upwardly at an angle of from about 74 degrees to about 77 degrees relative to the seat plane when the chair is unoccupied, and a third section curving from the second section forwardly and upwardly at an angle of from about 72 degrees to about 77 degrees relative to the seat plane when the seat is unoccupied, the first and second sections joining from about 5 to about 8 inches above the seat plane in a first smooth curve having a radius of curvature of from about 4 to about 7 inches, the first curve being convex relative to the seat plane, the second and third sections joining from about 16 to about 21 inches above the seat plane in a second smooth curve having a radius of curvature of from about 30 to about 50 inches, the second curve being concave relative to the seat plane.

10. The chair of claim 9 in which the apex of the second curve is rearward of the apex of the first curve by from about 2 to about 4 inches measured parallel to the seat plane of the unoccupied chair.

11. The chair of claim 9 in which the first curve has a radius of curvature of about $5\frac{1}{2}$ inches, the second curve has a radius of curvature of about 40 inches, the first and second sections join at about 7 inches above the seat plane and the second and third sections join at about 18 inches above the seat plane.

12. The chair of claim 9 in which the top of the back is about 28 to about 34 inches above the seat plane.

13. The chair of claim 9 in which the seat and back are each formed of a flexible member supported by the seat-supporting and the back-supporting members.

14. In a rocking chair comprising a base, a seat, a back, and arms above the seat and generally parallel to the plane of the seat, the improvement comprising:

(a) the arms extending forwardly of the seat in a direction generally parallel to the plane of the seat;

(b) a pair of substantially rigid supports extending upwardly from the base for supporting the arms, the back, and the seat, each arm being fixedly supported in front of and above the seat by a respective one of the supports to resist forward, rearward, and vertical movement of the forward portions of the arms when sitting down into and rising out of the chair, the supports alone supporting the seat, the back, and the arms; and (c) means for permitting the seat, back, and arms to rock with respect to the base.

15. The chair of claim 14 in which the seat is supported by a pair of seat-supporting members and the back is supported by a pair of back-supporting members.

16. The chair of claim 15 in which each seat-supporting member is attached to a corresponding back-supporting member.

17. The chair of claim 16 in which the attached seat-supporting member and back-supporting member are integral and continuously flexible.

18. The chair of claim 14 in which the means for permitting comprises means for cantilevering the arms, the back, and the seat from the supports above and forward of the seat for rocking without instability.

19. The chair of claim 18 in which the seat, back and arms rock about a horizontal axis above the seat.

20. The chair of claim 19 in which the horizontal axis is forward of the seat.

21. The chair of claim 14 in which the supports are upright legs attached to the forward end of the base.

* * * * *